US005606141A

United States Patent [19]

Leichtfried

[11] Patent Number: 5,606,141

[45] Date of Patent: Feb. 25, 1997

[54] ELECTRICAL CONDUCTOR IN LAMPS

[75] Inventor: Gerhard Leichtfried, Reutte, Austria

[73] Assignee: Schwarzkopf Technologies Corporation, New York, N.Y.

[21] Appl. No.: 491,637

[22] Filed: Jun. 19, 1995

[30] Foreign Application Priority Data

Jul. 5, 1994 [AT] Austria ..... 1323/94

[51] Int. Cl.[6] ..... C22C 29/12

[52] U.S. Cl. ..... 75/235; 75/245; 252/512; 252/515; 252/521; 313/341

[58] Field of Search ..... 75/235, 245; 252/512, 252/515, 521; 313/341

[56] References Cited

U.S. PATENT DOCUMENTS

| | | | |
|---|---|---|---|
| 982,751 | 1/1911 | Thowless . | |
| 4,254,300 | 3/1981 | Thompson-Russell | 174/50.64 |
| 4,755,712 | 7/1988 | Mujahi et al. | 313/331 |
| 5,021,711 | 6/1991 | Madden et al. | 313/623 |
| 5,077,505 | 12/1991 | Ekkelboom et al. | 313/623 |

FOREIGN PATENT DOCUMENTS

| | | | |
|---|---|---|---|
| 386612 | 9/1988 | Austria | C22C 27/04 |
| 395493 | 1/1993 | Austria | H01K 1/40 |
| 0098858 | 5/1988 | European Pat. Off. | H01J 61/36 |
| 0311308 | 4/1989 | European Pat. Off. | C03C 27/02 |
| 0275580 | 8/1991 | European Pat. Off. | C22C 27/04 |
| 0309749 | 10/1993 | European Pat. Off. | H01J 5/46 |
| 2947230 | 6/1980 | Germany | H01J 61/36 |
| 3006846 | 9/1980 | Germany | H01J 61/36 |
| 60-058296 | 12/1985 | Japan . | |

*Primary Examiner*—Ngoclan Mai
*Attorney, Agent, or Firm*—Morgan & Finnegan, L.L.P.

[57] ABSTRACT

The present invention relates to a strip-like current feeder based on molybdenum-yttrium oxide, for electric lamps with a metal/glass sealing. In addition to molybdenum-yttrium oxide, the strip material contains 0.03 to 1.0% by weight cerium oxide and the ratio of cerium oxide to yttrium oxide amounts to 0.1 to 1. As compared to known current feeders, the current feeder according to the present invention has a distinctly enhanced resistance to corrosion or oxidation.

8 Claims, No Drawings

ELECTRICAL CONDUCTOR IN LAMPS

FIELD OF THE INVENTION

The invention relates to an electrical conductor made of etched strip material based on molybdenum-yttrium oxide, as the current feeder in lamps with a metal/glass sealing.

BACKGROUND OF THE INVENTION

The material and shape of the current conductor or current feeder of electrical lamps having a glass bulb quite substantially determine the manufacture, function and quality of such lamps. The term "lamps" especially comprises halogen filament lamps and discharge lamps such as mercury vapor high-pressure lamps, halogen-metal vapor lamps, and xenon-HP-discharge lamps.

Much attention has been paid in the past to this technical field. Electrical conductors for feeding current in lamps with or without gas filling are, as a rule, fused in quartz glass or squeezed into the latter. Molybdenum, owing to its high melting point and its favorable coefficient of thermal expansion as compared to glass, has been found to be a suitable conductor material for feeding current.

Other material requirements a molybdenum conductor is expected to satisfy are ductility, good moldability, high mechanical strength, resistance to oxidation or corrosion, especially versus halides, and fusibility with other components of the conductor.

The problem of DE-C-29 47 230 is to make available an electric lamp with a current feeder of superior mechanical strength, and this patent proposes that the molybdenum foil used heretofore be replaced by a molybdenum foil in which yttrium oxide particles are dispersed in the molybdenum in an amount of 0.25 to 1% of the weight of the molybdenum. However measured against current requirements, this material has inadequate corrosion resistance and especially insufficient oxidation properties.

DE-C-30 06 846 proposes coating of the electrical conductor for the current feed—the latter being a molybdenum or a tungsten foil—with a second metal selected from the group of tantalum, niobium, vanadium, chromium, zirconium, titanium, lanthanum, scandium and hafnium. According to this patent, the molybdenum or tungsten conductor can be coated by using vapor deposition, cathode atomization, electrolysis and other methods.

Such a coating process, however, is complicated and cost intensive, and, if carried out in an economical way, does not assure an evenly thick application in a way such that the desired protection against corrosion is assured in all areas of the coating. Furthermore, current feeders coated in this way lack sufficient fusibility particularly when chromium is used as the coating material. It may be necessary to first fuse the basic material with another component part before it is coated.

U.S. Pat. No. 5,021,711 relates to the protection of molybdenum foils against oxidation as well, such foils being used as conductors in vacuum lamps. It proposes that the molybdenum foil be refined superficially by means of ion implantation, using chromium, aluminum, or combinations of said metals. Adequate fusibility is lacking in this case as well, and this process is complicated and expensive for this type of material. Furthermore, the manufacturing costs of the mass produced quartz lamps are increased by this process to an unsatisfactory extent.

Furthermore, EP-B-0 309 749 deals with increasing the resistance of molybdenum to oxidation, such molybdenum being intended for use in electric lamps as an electrical conductor within the sealing zone. An enhanced useful life of the material, especially in a corrosive environment at elevated temperatures from 250° to 600° C., is to be accomplished by coating the basic molybdenum material with an alkali metal silicate.

Drawbacks of an electrical conductor produced in this manner include its high manufacturing cost and high brittleness or susceptibility to breakage of such components. Again due to the lack of adequate fusibility, it is necessary to "go the expensive way", i.e., first fusing and then coating.

For increasing the resistance to oxidation and also the fusibility and resistance to media containing hydrogen, EP-B-0 098 858 proposes coating of the molybdenum current feeder with a layer of rhenium. Rhenium is an expensive material. The known methods for producing such a coating are costly, which means in this case too, the main drawback again is inadequate economy of the electrical conductors treated in such a way.

A molybdenum alloy used for electrical conductors as the current feeder in lamps is known from AT-B 395 493, such alloy consisting of 0.01 to 5% by weight of one or several oxides of the lanthanides, the balance being Mo.

As compared to other known conductor materials, this material does in fact offer excellent fusibility and resistance to high temperatures; however, other application-specific material features are less favorable than those of individual, previously known Mo-alloys. The sum of all properties of this material recommends its use as a wire-like current feeder fused in hard glass, but not as a strip or foil fused in quartz glass.

In addition to the selection of the material, processing of the latter when it is fused as an electrical conductor in lamp glass is of special importance. For example, a special process is known from EP-A 0 311 308, by which the metal and the glass are fused with each other in a special way within the sealing zone in the presence of a hydrogen/nitrogen gas mixture. However, this method and others cannot in any case satisfactorily compensate the known problems posed when using such materials as electrical conductors.

Finally, according to EP-B-0 275 580, it is proposed to manufacture current feeder wires for lamps from an alloy substantially consisting of molybdenum, 0.01 to 2% by weight yttrium oxide, and 0.01 to 0.8% by weight molybdenum boride. This alloy was intended as an improvement over a potassium-silicon-doped molybdenum alloy; however, it does not offer any improvements versus a pure molybdenum-yttrium oxide alloy, especially not with respect to the resistance of the latter to oxidation. A serious drawback of this material is that it frequently causes socket cracks in the glass within the zone where it is fused or squeezed in, such cracking being caused by changes in the strength of the material in the course of recrystallization of the latter in the fusing step.

JP-B-85058296 describes a heat-resistant alloy consisting of 10 to 70% by weight yttrium oxide and/or cerium oxide, the balance molybdenum, which is used for protective tubes for thermoelements. This publication does not disclose anything about any suitability of the alloy for current feeders in lamps.

SUMMARY OF THE INVENTION

Therefore, an object of the present invention is to make available a conductor material for current feeders in vacuum lamps with glass bulbs, which does not exhibit the drawbacks outlined above with respect to the state of the art, and which particularly has a higher resistance to corrosion or oxidation than the known material based on molybdenum yttrium oxide.

According to the invention, this and other objects are accomplished in a surprising and unexpected manner by incorporating an electrical conductor made of etched strip material based on molybdenum-yttrium oxide as current feeder in lamps with a metal/glass sealing. In addition to Mo-$Y_2O_3$, the strip material contains up to 1.0% by weight cerium oxide, whereby the cerium oxide:yttrium oxide ratio amounts to 0.1 to 1.

The foregoing specific object and advantage of the invention is illustrative of those which can be achieved by the present invention and are not intended to be exhaustive or limiting of the possible advantages which can be realized. Thus, this and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

DETAILED DESCRIPTION OF THE INVENTION

Lamps according to the present invention comprise various types of halogen filament lamps as well as discharge lamps such as mercury vapor high-pressure lamps, xenon high-pressure lamps, and halogen-metal vapor lamps. The strip material is used in the lamp with many different dimensions, but particularly in the form of a thin, elliptically etched foil. The electrical conductors according to the invention can be used without any limitation while maintaining the methods currently used in the manufacture of lamps, especially the metal-and-glass fusion or squeeze-in technology. This particularly applies also to methods by which the electric current conductor according to the present invention is fused at its ends with other current feeder components, and fused in quartz glass or squeezed into the latter, including the fusion joints.

Particularly advantageous embodiments of the present invention are specified in the dependent claims.

It was not foreseeable that the electrical conductor according to the present invention effects, in view of an overall comparable oxide concentration, a sudden increase in the resistance to corrosion, and especially to oxidation versus a molybdenum material that is only doped with yttrium oxide as the dispersoid. This permits, for example, longer storage of lamps manufactured with such conductors, and effects at the same time a distinctly prolonged useful life during operation.

Other quality features of the electrical conductor according to the invention are not reduced as compared to the best conductor materials known heretofore, which includes:

- Low tendency of foil detachment in squeeze or fusion seals due to the particularly favorable surface structure of the etched conductor strip;
- Low tendency of foil cracking due to a stable fine granularity of the material even after recrystallization in the course of the step in which the conductor is fused in;
- Prevention of socket cracks in the quartz glass due to the comparatively low recrystallization temperature below 1300° C., resulting in low tension build-up between the electrical conductor material and the glass.

The methods of powder metallurgy widely used at the present time are employed for the manufacture of the electrical conductor according to the present invention—see, for example, AT-B 386 612 in this regard.

Furthermore, use is made of the etching agents and etching methods as currently used for molybdenum strip material or molybdenum foils. This particularly relates also to the widely used methods for thinning the lateral marginal zones of a conductor strip. The following examples describe advantageous embodiments of the electrical conductor of the invention, as well as its manufacture. These examples are supplemented by comparative tests with respect to the resistance of such electrical conductors to oxidation.

EXAMPLE 1

For manufacturing a strip material according to the present invention, molybdenum powder was prepared by means of liquid doping with a most finely distributed mixture of 0.55% by weight yttrium-cerium mixed oxide with a 0.25 ratio of cerium oxide to yttrium oxide (oxide particle size <0.1 μm). The powder was compressed by matrix pressing and subsequently sintered for 5 hours at 1850° C. The rolling bars so produced were processed by hot and cold rolling to strips with a thickness of 0.045 mm, subsequently cut, then shaped into the elliptical shape typical of the fused-in strip by using an electrolytic etching process, and annealed at 800° C. under $H_2$-atmosphere.

EXAMPLE 2

A molybdenum strip material according to the present invention comprising 0.55% by weight cerium-yttrium mixed oxide with a 0.43 ratio of cerium oxide to yttrium oxide was produced according to the manufacturing conditions specified in example 1.

Comparative Test

The strip materials produced according to the invention as specified in examples 1 and 2 were tested for comparison purposes together with a strip material according to the state of the art consisting of molybdenum with 0.55% by weight yttrium oxide, using the following tests:

(a) Oxidation test at 350° C./115 h;

(b) Oxidation test at 50° C./$H_2O$ steam/168 h;

(c) Squeeze-in test (100 lamps); testing for foil detachment, foil cracking and socket cracks in the quartz glass; and (d) Overstress test with localization of heat in the socket.

The results are compared in Table 1 below.

TABLE 1

| Strip Material | (a) Oxidation Rate (μg/cm² h) | (b) Oxidation Rate (μg/cm² h) | (c) | (d) Relative Temperature Stressability |
|---|---|---|---|---|
| State of the art Mo with 0.55% by wt. $Y_2O_3$ | 120 | 160 | + | 1.0 |
| According to the invention: Mo with 0.55% by wt. mixed oxide according to Example 1 | 80 | 130 | + | 1.2 |
| According to the invention: Mo with 0.55% by wt. mixed oxide according to Example 2 | 85 | 115 | + | 1.2 |

The comparison shows a distinct improvement in the properties of the strip material according to the present invention versus the strip material according to the state of the art.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

What is claimed is:

1. An electrical conductor made of etched strip material based on molybdenum-yttrium oxide, as current feeder in lamps with a metal/glass sealing, said strip material comprising, in addition to Mo-$Y_2O_3$, up to 1.0% by weight cerium oxide, whereby the cerium oxide:yttrium oxide ratio amounts to 0.1 to 1.

2. The electrical conductor according to claim 1, wherein the ratio of cerium oxide to yttrium oxide amounts to 0.1 to 0.4.

3. The electrical conductor according to claim 1, further comprising 0.05 to 0.15% by weight cerium oxide, and wherein the ratio of cerium oxide to yttrium oxide amounts to 0.15 to 0.20.

4. The electrical conductor according to claim 1, further comprising molybdenum with 0.4 to 0.5% by weight $Y_2O_3$ and 0.08% by weight $CeO_2$.

5. The electrical conductor according to claim 1, wherein said cerium oxide is substituted in an amount of less than 40% by weight by one or several of the following oxides: $La_2O_3$, $Er_2O_3$, $SiO_2$, $HfO_2$, $ZrO_2$, $TiO_2$, $Al_2O_3$.

6. The electrical conductor according to claim 2, wherein said cerium oxide is substituted in an amount of less than 40% by weight by one or several of the following oxides: $La_2O_3$, $Er_2O_3$, $SiO_2$, $HfO_2$, $ZrO_2$, $TiO_2$, $Al_2O_3$.

7. The electrical conductor according to claim 3, wherein said cerium oxide is substituted in an amount of less than 40% by weight by one or several of the following oxides: $La_2O_3$, $Er_2O_3$, $SiO_2$, $HfO_2$, $ZrO_2$, $TiO_2$, $Al_2O_3$.

8. The electrical conductor according to claim 4, wherein said cerium oxide is substituted in an amount of less than 40% by weight by one or several of the following oxides: $La_2O_3$, $Er_2O_3$, $SiO_2$, $HfO_2$, $ZrO_2$, $TiO_2$, $Al_2O_3$.

* * * * *